US006281789B1

(12) United States Patent
Furtado et al.

(10) Patent No.: US 6,281,789 B1
(45) Date of Patent: Aug. 28, 2001

(54) ALARM SYSTEM HAVING IMPROVED CONTROL OF NOTIFICATION APPLIANCES OVER COMMON POWER LINES

(75) Inventors: Michael A. Furtado, Shrewsbury; Mark P. Barrieau, Baldwinville; Anthony J. Capowski, Westford, all of MA (US)

(73) Assignee: Simplex Time Recorder Company, Westminster, MA (US)

( * ) Notice: Subject to any disclaimer, the term of this patent is extended or adjusted under 35 U.S.C. 154(b) by 0 days.

(21) Appl. No.: 09/312,108

(22) Filed: May 14, 1999

(51) Int. Cl.[7] ..... G08B 29/00

(52) U.S. Cl. ..... 340/506; 340/310.01; 340/534; 340/537; 340/538; 340/310.04

(58) Field of Search ..... 340/538, 310.04, 340/506, 534, 537, 288, 310.01, 310.02, 825.14, 825.2

(56) References Cited

U.S. PATENT DOCUMENTS

| | | | | |
|---|---|---|---|---|
| 4,262,286 | | 4/1981 | Tanigawa | 340/584 |
| 4,274,084 | | 6/1981 | Haus | 340/326 |
| 4,540,890 | | 9/1985 | Gangemi et al. | 307/40 |
| 4,555,695 | * | 11/1985 | Machida et al. | 340/538 |
| 4,785,195 | | 11/1988 | Rochelle et al. | 307/18 |
| 5,400,246 | * | 3/1995 | Wilson et al. | 340/825.06 X |
| 5,525,962 | | 6/1996 | Tice | 340/506 |
| 5,559,492 | | 9/1996 | Stewart et al. | 340/331 |
| 5,598,139 | | 1/1997 | Karim et al. | 340/286.11 |
| 5,608,375 | | 3/1997 | Kosich | 340/293 |
| 5,751,210 | | 5/1998 | Kosich | 340/293 |

* cited by examiner

*Primary Examiner*—Daryl Pope
(74) *Attorney, Agent, or Firm*—Hamilton, Brook, Smith & Reynolds P.C.

(57) ABSTRACT

An alarm system which includes multiple notification appliances for signaling an alarm condition. The system controller intelligently controls the notification appliances including notification devices such as an audible or visual alarm through multi-bit digital messages sent over common communication lines. The alarm system has both a supervisory or standby mode and an active mode of operation. In the standby mode, the notification appliances are powered at a first polarity DC voltage. In an active mode of operation, the first polarity voltage is reversed (or forward biased) to energize all the notification appliances on the communication lines. The system controller controls operation of the visual alarms by issuing synchronization signals, wherein the line voltage drops to zero, which trigger the visual alarms. An audible alarm command signal is embedded within the synchronization signal to control operation of the audible alarm.

45 Claims, 2 Drawing Sheets

ALARM SYSTEM HAVING IMPROVED CONTROL OF NOTIFICATION APPLIANCES OVER COMMON POWER LINES

BACKGROUND OF THE INVENTION

Typical building fire alarm systems include a number of fire detectors positioned throughout a building. Signals from those detectors are monitored by a system controller, which, upon sensing an alarm condition, sounds audible alarms throughout the building. Flashing light strobes may also be positioned throughout the building to provide a visual alarm indication. In a system sold by Simplex Time Recorder Company disclosed in U.S. Pat. No. 4,796,025 (hereinafter the '025 patent), the contents of which are incorporated herein by reference, fire detectors are monitored and controlled through common power lines which also serve as communication links. Communications are by means of encoded pulses of voltage drops in power. Notification appliance circuits (NACs) may also be coupled to those communication links through a NAC controller but additional power is applied to the NACs due to the higher power requirements of NACs.

A number of notification appliances comprising audible alarms and strobes generally referred to as notification devices, are typically connected across common power lines on a notification circuit, either directly coupled to the central panel or through a NAC controller on a detector circuit. A first polarity DC voltage may be applied across the notification circuit in a supervisory mode of operation. In this supervisory mode, rectifiers at the notification appliances are reverse biased so that the alarms are not energized, but current flows through the power lines at the notification circuit to an end-of-line resistor and back, allowing the condition of those lines to be monitored. With an alarm condition, the polarity of the voltage applied across the power lines is reversed to energize all notification appliances on the notification circuit.

U.S. Pat. No. 5,559,492 issued to Stewart el al. (hereinafter the '492 Stewart patent), the contents of which are incorporated herein by reference, further discloses that the visual alarms, or strobes, may be synchronized to fire simultaneously with power interruptions, also referred to as synchronization pulses, in the power lines. Additional timing lines for synchronizing the strobes are not required because the synchronizing signals are applied through the existing common power lines.

SUMMARY OF THE INVENTION

Extending full communications as disclosed in the '025 patent to NACs has drawbacks. For example, the signaling scheme inherently limits the amount of time that can be used to recharge the strobe between flashes. This is a significant detriment in alarm systems where the line voltage fluctuates widely due to load conditions and, consequently, more time is required to recharge the strobes to their respective firing voltage levels.

An alarm system of the present invention controls the operation of audible and visual alarm over common power lines and minimizes the time in which the line voltage is reduced to zero. A message is sent from a system controller to notification appliances having at least one audible alarm. The message includes a synchronization signal and a command signal embedded within the synchronization signal that controls the audible alarm. The notification appliance responds as directed by said command signal.

Preferably, the notification appliance includes a visual alarm that flashes upon receipt of the synchronization signal.

The audible alarm responds to the command signal by turning off, turning on, or by generating a temporal or march time alarm.

In a preferred embodiment, the alarm system includes multiple notification appliances for signaling an alarm condition. The system controller intelligently controls the notification appliances including notification devices such as an audible or visual alarm through multi-bit digital messages sent over common communication lines. The alarm system has both a supervisory or standby and active mode of operation. In the standby mode, the notification appliances are powered at a first polarity DC voltage. In an active mode of operation, the first polarity voltage is reversed (or forward biased) to energize all the notification appliances on the communication lines. The system controller controls operation of the visual alarms by issuing synchronization signals, wherein the line voltage drops to zero, which trigger the visual alarms. An audible alarm command signal is embedded within the synchronization signal to control operation of the audible alarm.

The notification appliance includes a timer that controls operation of the audible alarm. In a preferred embodiment of the present invention, the timer is reset by the command signal which is intermittently embedded in the synchronization signal.

Preferably, the command signal is a series of negative voltage pulses and the synchronization signal is a drop-out in power supplied to the notification appliance. The command signal includes multi-bit voltage pulses extending from the drop-out.

According to yet further aspects of the present invention, an alarm system is provided having a system controller for generating a plurality of multi-bit messages that control at least one notification appliance that includes an audible alarm. A pair of communication lines connects the notification appliance to the system controller. The notification appliance includes an electronic circuit that receives a message comprising a synchronization signal and a command signal within the synchronization signal, wherein the command signal directs operation of the audible alarm.

Thus, the alarm system of the present invention controls operation of audible and visual alarms over common power lines while minimizing the time in which the line voltage is reduced to zero. This is accomplished by embedding a command signal, which controls the function of the audible alarms, in a synchronization signal used to control simultaneous actuation of the visible alarms. This allows extended charging time of the visual alarms between synchronization signals which is beneficial where the line voltage fluctuates due to load conditions thereby requiring more time to recharge the visual alarms to their respective firing voltage levels.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
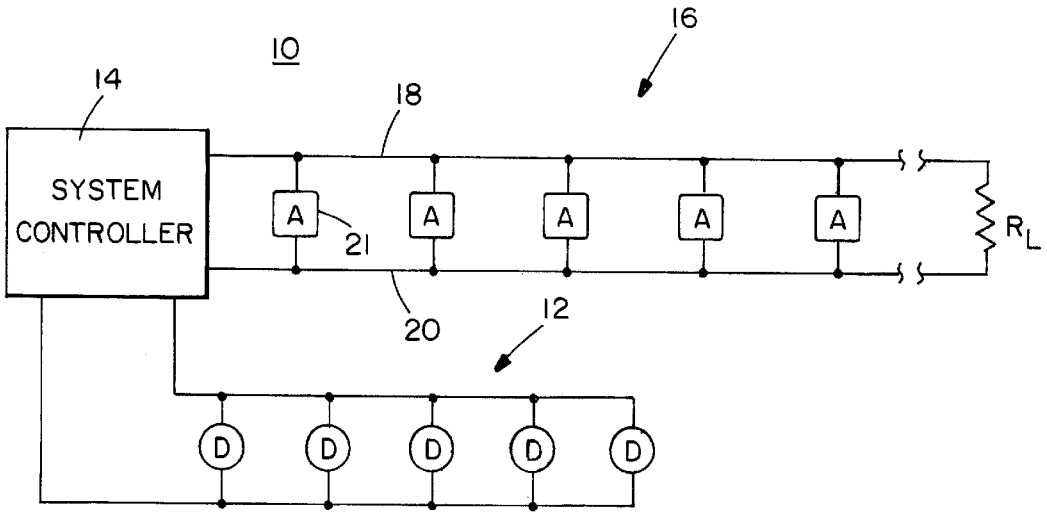
FIG. 1 illustrates an alarm system embodying a preferred embodiment of the present invention.

An alarm system 10 constructed according to the principles of the present invention is illustrated in FIG. 1. As in a conventional alarm system, the system includes one or more detector networks 12 having individual alarm condition detectors D which are monitored by a system controller 14. When an alarm condition is sensed, the system controller 14 signals the alarm to the appropriate devices through at least one network 16 of addressable alarm notification appliances A. Each device, also called a notification appliance 21, may include one or more notification devices, for example, a visual alarm (strobe), an audible alarm (horn), or a combination thereof (A/V device).

As shown, all of the notification appliances are coupled across a pair of power lines 18 and 20 that advantageously also carry command messages from the system controller 14 to the notification appliances 21.

In a supervisory mode of operation, a first polarity DC voltage is applied across the notification circuit 16. In this mode, rectifiers at the notification appliances are reverse biased so that the audible and visual alarms are not energized, but current flows through the power lines 18, 20 to an end-of-line resistor $R_L$ and back, allowing the condition of those lines to be monitored.

With an alarm condition, also referred to as active mode, the polarity of the voltage applied across the power lines 18, 20 is reversed (or forward biased) to energize all notification appliances 21 on the notification circuit 16. In a preferred embodiment of the present invention, the first polarity DC is −24 VDC and the forward biased voltage is 24 VDC, although other voltages can be used in accordance with the present invention.

Figure 2:
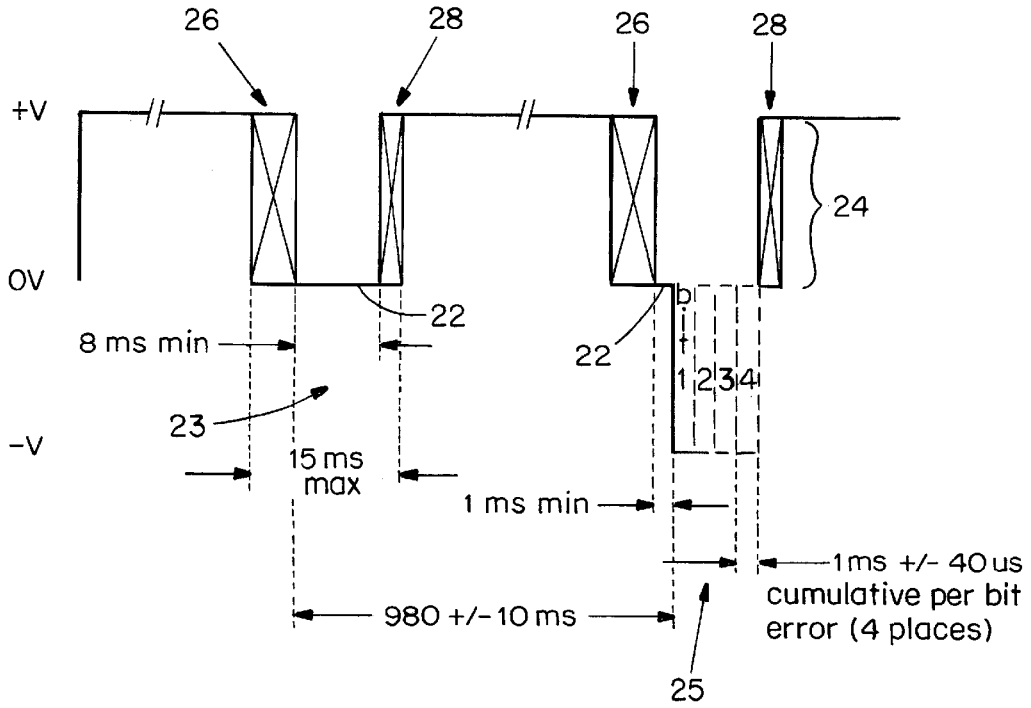
FIG. 2 illustrates exemplary control messages between the system controller and a notification appliance during an alarm condition.

FIG. 2 illustrates two control messages 23, 25 issued from the system controller 14 to the notification appliances 21 during an alarm condition. Each control message 23, 25 includes a synchronization signal 22 which actuates the visual alarms on the notification circuit 16. Signal 22 is a "drop-out" or interruption in power to the notification appliances 21 wherein the line voltage drops to zero. Synchronization signal 22 is preceded by a relay operate and bounce 26 and followed by a relay release and bounce 28 as understood in the art.

Control message 25 includes a command signal 24 embedded within synchronization signal 22. In a preferred embodiment, command signal 24 includes a series of negative voltage pulses or data pulses extending from zero voltage during the synchronization signal 22. Each notification appliance 21 includes decoding circuitry 38 and a microcontroller 42 (seen in FIG. 4), with programmed instructions, which controls the audible alarm according to the command signal 24 received.

In a preferred embodiment of the present invention, command signal 24 includes four bits. The first bit is defined by a negative voltage pulse extending approximately to the reverse polarity value used during the supervisory mode. The first bit is followed by a predetermined number of bits that define a predetermined code that specifies a desired operation. Preferably, three bits follow the first bit. A data 1 bit defines a reverse polarity voltage amplitude, and a data 0 is signaled with a zero voltage amplitude. Each bit is further defined by a predetermined time duration. Preferably, each bit is transmitted for 1 ms+/−40 us. In an alternative embodiment of the present invention, command signal 24 comprises a modulated carrier signal.

Figure 3:
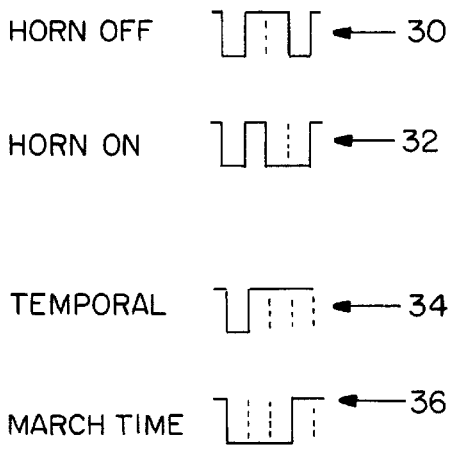
FIG. 3 illustrates exemplary command signals embedded within a synchronization signal of the control message.

The four bits allow for up to eight different commands. Exemplary command signals 24 used to control the horns are illustrated in FIG. 3. Reference numeral 30 refers to the command signal that turns the audible alarms off and is defined by "1001" bit code. Reference numeral 32 refers to the command signal that turns the audible alarms on and is defined by "1011" bit code. Reference numeral 34 refers to the command signal that triggers a Temporal cadence by the audible alarms and is defined by "1000". This pattern can be found in the National Fire Protection Association's National Fire Alarm Code, NFPA 72. Reference numeral 36 refers to the command signal that triggers a March Time by the audible alarms and is defined by "1110".

Preferably, command signal 24 is intermittently embedded within synchronization signal 22. Most preferably, the command signal 24 is sent periodically, for example, every eighth synchronization signal 22. Because the command signal 24 is embedded within the synchronization signal 22, extended charging time of the visual alarms between synchronization signals is realized. That is to say, the synchronization signal 22, which can include command signal 22, defines the only loss in power to the notification appliances 21. This minimization of power loss to the notification appliances 21 is beneficial where the line voltage fluctuates due to load conditions thereby requiring more time to recharge the visual alarms to their respective firing voltage levels.

Figure 4:
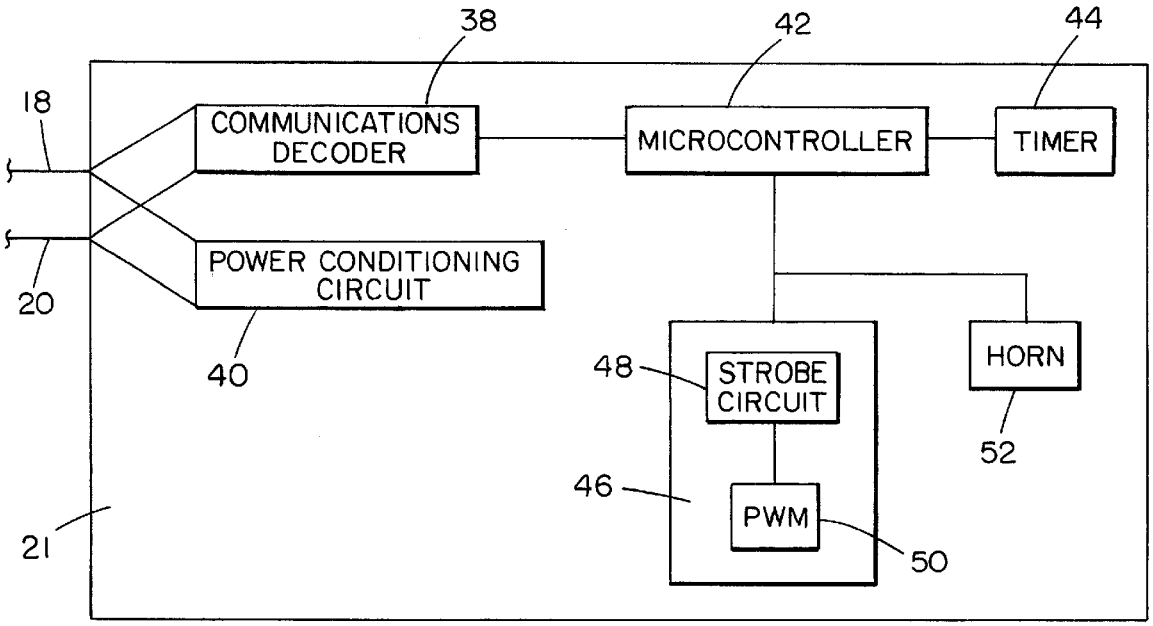
FIG. 4 illustrates, in block diagram, an exemplary notification appliance.

As shown in FIG. 4, power lines 18 and 20 connect to the notification appliance 21, each power line connecting to a communications decoder 38 and a power conditioning unit 40. As understood in the art, the power conditioning unit 40 is used to maintain a constant power flow to the notification appliance 21. The communications decoder 38 is provided to interpret or decode the command messages received from the system controller 14. Communicating with the decoder 38 is microcontroller 42 which controls the visible alarm 46, such as a strobe, and the audible alarm. Audible alarm 52 can include any enunciator device such as a bell, chime, horn, or whistle. An internal timer 44 connected to microcontroller 42 is used to control the actuation of the visual and/or audible alarm of a respective notification appliance. Alternatively, timer 44 can be positioned within microprocessor 42. Preferably, the timers 44 of each notification appliance 21 are resynchronized by command signal 24 such that the audible alarms 52 are synchronized during alarm conditions. One method of resynchronizing the timers 44 is by resetting the same.

Visual alarm 46 includes a strobe circuit 48 which includes a charging circuit and a firing circuit similar to those disclosed in the '492 Stewart patent. A pulse width modulator (PWM) 50 is provided in alarm 46 to control the charging circuit. Microcontroller 42 turns the power to the PWM 50 on/off at the beginning/end of a strobe sequence.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method for controlling an alarm system, comprising:

sending a message to a notification appliance having at least one audible alarm, said message comprising a drop in power forming a synchronization pulse and a command signal embedded within the synchronization pulse to control the audible alarm; and at the notification appliance, responding as directed by said command signal.

2. The method of claim 1, wherein said notification appliance includes a visual alarm that flashes upon receipt of the synchronization pulse.

3. The method of claim 1, wherein the audible alarm responds by turning off.

4. The method of claim 1, wherein the audible alarm responds by turning on.

5. The method of claim 1, wherein the audible alarm responds by generating a temporal alarm.

6. The method of claim 1, wherein the audible alarm responds by generating a march time alarm.

7. The method of claim 1, wherein the command signal includes a series of negative voltage pulses.

8. A notification appliance having at least one audible alarm, comprising:

means for decoding a message comprising a synchronization pulse and a command signal embedded within the synchronization pulse; and means for responding as directed by said command signal at said audible alarm.

9. A notification appliance, comprising:

at least one notification device including an audible alarm; and an electronic circuit that decodes a message comprising a synchronization pulse and a command signal embedded within the synchronization pulse, the circuit directing operation of the audible alarm in response to the command signal.

10. The notification appliance of claim 9, wherein the notification appliance includes at least one visual alarm actuated by the synchronization pulse.

11. The notification appliance of claim 9, wherein the command signal directs the audible alarm to turn off.

12. The notification appliance of claim 9, wherein the command signal directs the audible alarm to turn on.

13. The notification appliance of claim 9, wherein the command signal directs the audible alarm to generate a temporal alarm.

14. The notification appliance of claim 9, wherein the command signal directs the audible alarm to generate a march time alarm.

15. The notification appliance of claim 9, wherein the notification appliance includes a timer that controls operation of the audible alarm, the timer being reset by the command signal.

16. The notification appliance of claim 15, wherein the command signal is intermittently embedded within the synchronization pulse.

17. The notification appliance of claim 9, wherein the command signal is a series of negative voltage pulses.

18. The notification appliance of claim 9, wherein the synchronization signal pulse is a drop-out in power supplied to the notification appliance.

19. The notification appliance of claim 18, wherein the command signal includes multi-bit voltage pulses extending from the drop-out.

20. An alarm system, comprising:

a system controller for generating a plurality of multi-bit messages that control at least one notification appliance that includes an audible alarm;

a pair of communication lines connecting said at least one notification appliance to said system controller; and said at least one notification appliance including an electronic circuit that receives a message comprising a synchronization pulse and a command signal embedded within the synchronization pulse, the command signal directing operation of the audible alarm.

21. The notification appliance of claim 20, wherein the notification appliance includes at least one visual alarm actuated by the synchronization pulse.

22. The notification appliance of claim 20, wherein the command signal directs the audible alarm to turn off.

23. The notification appliance of claim 20, wherein the command signal directs the audible alarm to turn on.

24. The notification appliance of claim 20, wherein the command signal directs the audible alarm to generate a temporal alarm.

25. The notification appliance of claim 20, wherein the command signal directs the audible alarm to generate a march time alarm.

26. The notification appliance of claim 20, wherein the notification appliance includes a timer that controls operation of the audible alarm, the timer being reset by the command signal.

27. The notification appliance of claim 26, wherein the command pulse is intermittently embedded within the synchronization pulse.

28. The notification appliance of claim 20, wherein the command signal is a series of negative voltage pulses.

29. The notification appliance of claim 20, wherein the synchronization pulse is a drop-out in power supplied to the notification appliance.

30. The notification appliance of claim 29, wherein the command signal includes multi-bit voltage pulses extending from the drop-out.

31. A method for controlling a fire alarm system, comprising:

providing a plurality of notification appliances including at least one audible alarm in a supervisory mode of operation wherein a first polarity voltage is applied to said plurality of notification appliances;

reversing the polarity of the voltage during an alarm condition such that a second polarity voltage is applied to said notification appliances; and interrupting the second polarity voltage to the notification appliances and, during the interruption of power, transmitting a command signal to control operation of the audible alarm.

32. The method of claim 31, further comprising the step of providing at least one visual alarm which is actuated by the interruption of power.

33. The method of claim 31, wherein the command signal directs the audible alarm to turn off.

34. The method of claim 31, wherein the command signal directs the audible alarm to turn on.

35. The method of claim 31, wherein the command signal directs the audible alarm to generate a temporal alarm.

36. The method of claim 31, wherein the command signal directs the audible alarm to generate a march time alarm.

37. The method of claim 31, further comprising the step of resetting a timer of the notification appliance with the command signal, the timer controlling timed operation of the audible alarm.

38. The method of claim 37, wherein the command signal is intermittently embedded in the synchronization signal.

39. The method of claim 31, wherein the command signal is a series of negative voltage pulses.

40. The method of claim 31, wherein the command signal includes multi-bit voltage pulses extending from the interruption in power.

41. An alarm system, comprising:

a plurality of notification appliances, each notification appliance including at least one audible alarm and at least one visual alarm, a first polarity voltage being applied to the notification appliances in a standby mode of operation; and a system controller that controls the audible and visual alarms, the system controller reversing the first polarity voltage during an alarm condition such that a second polarity voltage is applied to the notification appliances, the system controller interrupting the second polarity voltage to simultaneously actuate the visual alarms and, during the interruption in power, transmitting a command signal to control operation of the audible alarm.

42. The alarm system of claim 41, wherein each notification appliance includes a timer that controls timed operation of the audible alarm, each timer being resynchronized to the other timers by the command signal.

43. The alarm system of claim 41, wherein the command signal is intermittently embedded in the interruption in power.

44. The alarm system of claim 41, wherein the command signal is a series of negative voltage pulses.

45. An alarm system, comprising:

means for generating a plurality of multi-bit messages that control at least one notification appliance that includes an audible alarm;

means for connecting said at least one notification appliance to said generating means; and said at least one notification appliance including means for decoding a message comprising a synchronization pulse , the command signal directing operation of audible alarm.

* * * * *